US006103049A

United States Patent [19]

Batdorf

[11] Patent Number: 6,103,049

[45] Date of Patent: Aug. 15, 2000

[54] METHOD AND APPARATUS FOR CUTTING, SEALING AND ENCAPSULATED FIBROUS PRODUCTS

[75] Inventor: Daniel Joseph Batdorf, Perrysburg, Ohio

[73] Assignee: Johns Manville International, Inc., Denver, Colo.

[21] Appl. No.: 08/251,494

[22] Filed: May 31, 1994

[51] Int. Cl.[7] ..... D06C 13/00

[52] U.S. Cl. ..... 156/251; 156/515; 156/88; 83/53; 83/177

[58] Field of Search ..... 156/251, 515, 156/88; 83/53, 177

[56] References Cited

U.S. PATENT DOCUMENTS 2,985,050 5/1961 Schwacha .
3,524,367 8/1970 Franz .
3,532,014 10/1970 Franz .
3,756,106 9/1973 Chadwick et al. .
3,877,334 4/1975 Gerber ..... 83/53 X
3,996,825 12/1976 Terry .
4,435,902 3/1984 Mercer et al. ..... 83/177 X
4,648,215 3/1987 Hashish .

*Primary Examiner*—Richard Crispino
*Attorney, Agent, or Firm*—John D. Lister

[57] ABSTRACT

A fibrous work piece, e.g. a glass fiber mat or blanket, is simultaneously cut, sealed and encapsulated using a focused, high energy liquid jet containing a sealant. The sealant in the focused, high energy liquid jet is deposited on and seals the edges of the kerf formed by the cutting operation to encapsulate dust and short length fibers formed by the cutting of the fibrous work piece. The focused, high energy liquid jet is emitted from a nozzle and the sealant is introduced into and mixed with the liquid before the liquid exits the nozzle. Portions of the fibrous work piece can be compressed by hold down shoes or by one or more high pressure air streams directed onto the work piece adjacent where the work piece is being cut to facilitate the formation of a cleaner edge on the kerf being cut in the fibrous work piece.

10 Claims, 2 Drawing Sheets

METHOD AND APPARATUS FOR CUTTING, SEALING AND ENCAPSULATED FIBROUS PRODUCTS

BACKGROUND OF THE INVENTION

The present invention relates to a method of and apparatus for cutting fibrous products and, in particular, to a method of and apparatus for cutting, sealing and encapsulating fibrous products so that dust and/or short lengths of fiber created by the cutting of the fibrous product will be retained in the fibrous product.

In the manufacture of fibrous products, such as, molded, non-molded, non-woven, cured and/or uncured fiber glass mat products and other fibrous products, the product must be cut and/or trimmed at certain stages of the manufacturing operation. Examples of such products are fiber glass vehicle headliners, fiber glass vehicle hoodliners, fiber glass air filtration media, fiber glass insulation, fiber glass air duct board, fiber glass mat board and carpeting. The cutting or trimming of such fibrous products produces dust and/or short lengths of fiber adjacent the kerf. The dust and/or short length fibers can be a nuisance and possible irritant to those persons handling and installing the products. Accordingly, there has been a need to minimize or greatly reduce the problems caused by the creation of dust and short length fibers during the cutting and trimming operations performed during the manufacture of these fibrous products.

Various methods have been used to cut and/or trim the fibrous products discussed above. These methods include the use of band saws, 3D trimmers, heated blade trimmers, die boards, rotary saws, choppers and high energy fluid jets. However, none of these methods of cutting and trimming such fibrous products have eliminated the problems associated with the creation of dust and short length fibers during the cutting and/or trimming process.

U.S. Pat. No. 3,996,825, issued to Rupert Douglas Terry on Dec. 14, 1976, and entitled Method and Apparatus for Cutting a Web Fibrous Non-woven Mat, discloses a method of cutting fibrous products with a high energy fluid jet. The disclosure of U.S. Pat. No. 3,996,825, is hereby incorporated herein by reference in its entirety.

SUMMARY OF THE INVENTION

The method and apparatus of the present invention provide an effective and efficient way to cut and trim fibrous products which greatly reduces or minimizes the problems associated with the creation of dust and short length fibers during a cutting or trimming operation. The method and apparatus of the present invention cut and trim fibrous products with a high energy water jet containing a sealant that seals the edges of the kerf created by the cutting operation and encapsulates the dust and short length fibers within the fibrous product. In addition to sealant, the high energy water jet can carry anti-static agents, dyes, and/or adhesives which will also be deposited on the edges of the kerf formed by the cutting operation.

In the method of the present invention, sealant is mixed with a high pressure, high velocity liquid stream, such as water, within a cutting head. The mixture of liquid and sealant is discharged as a high pressure, high velocity focused, liquid jet that is directed at a surface of the fibrous work piece being cut. The high pressure, high velocity, focused liquid jet cuts the fibrous work piece by eroding fibers of the work piece and simultaneously deposits the sealant on the edges of the kerf formed by the cutting operation to seal the edges and encapsulate dust or short length fibers caused by the cutting of the fibrous work piece.

When thin fibrous mat products are being cut, air or mechanical hold down means can be used to facilitate the cutting operation. In the preferred embodiment for cutting, sealing and encapsulating uncured fibrous mat products, the air hold down assembly is used so that the uncured binder in the fibrous product will not cause the product to stick to the hold down means. In the air hold down assembly, controlled pressurized air streams are directed onto the surface of the fibrous mat product adjacent the point of contact of the high energy, liquid jet with the fibrous mat product. The air streams compress portions of the fibrous mat product adjacent the point of contact of the high energy liquid jet as the fibrous mat product is being cut by the liquid jet. By compressing the fibrous mat product in this manner, the formation of uneven "paper tear" edges is prevented and a much more even cut or kerf is formed in the fibrous mat product than would otherwise be obtained. In the preferred embodiment for cutting, sealing and encapsulating cured fibrous mat products, the mechanical hold down assembly comprising a pair of hold down shoes is used instead of the air hold down assembly.

DESCRIPTION OF PREFERRED EMBODIMENTS

Figure 1:
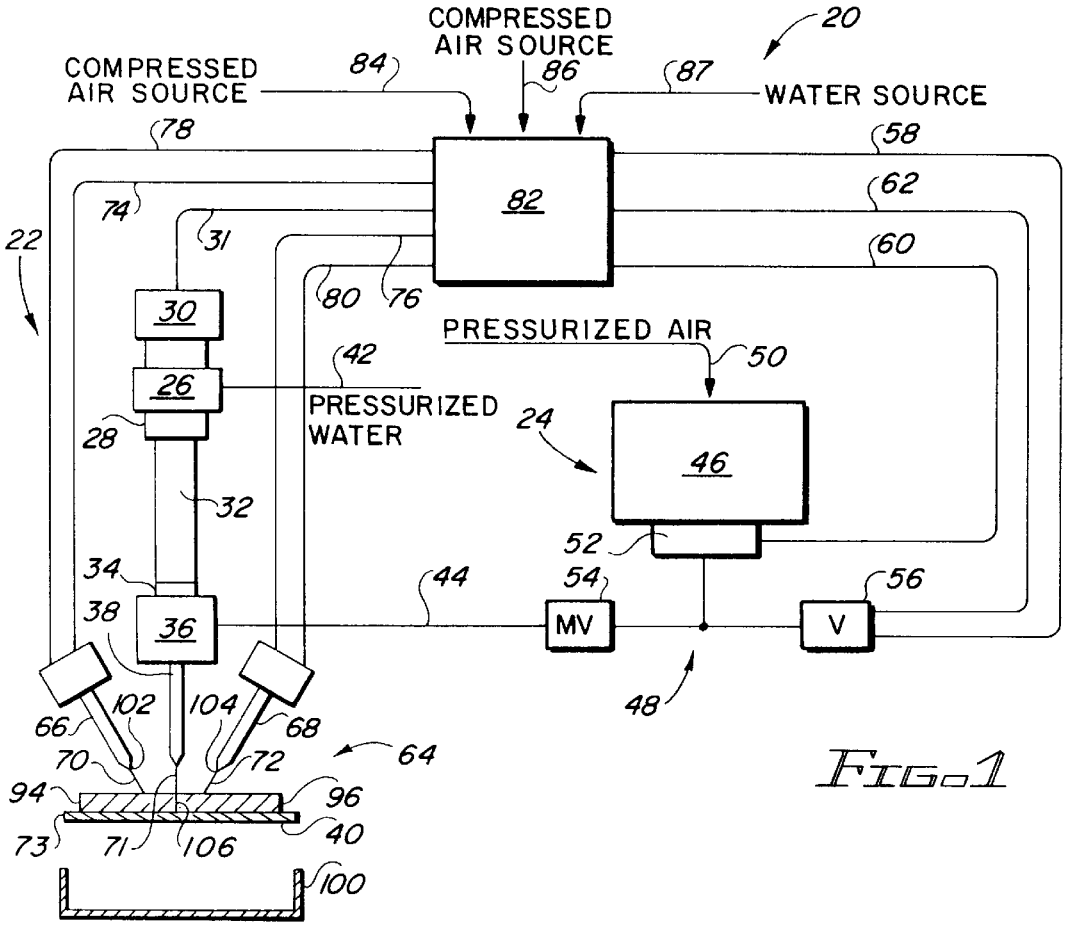
FIG. 1 is a schematic view of a cutting, sealing and encapsulating apparatus and air hold down assembly of the present invention.

FIG. 1 shows a cutting, sealing and encapsulating apparatus 20 of the present invention which includes a cutting head 22 and a sealant metering system 24. The cutting head 22 is of the type disclosed in U.S. Pat. No. 4,648,215, issued to Mohamed A. Hashish on Mar. 10, 1987, entitled Method and Apparatus for Forming a High Velocity Liquid Abrasive Jet, and the disclosure of this patent is hereby incorporated herein by reference in its entirety. The preferred cutting head used in the cutting, sealing and encapsulating system 20 of the present invention is the PASER II Abrasive jet cutting head, manufactured by Flow International Corporation of Kent, Wash.

As shown in FIG. 1, the cutting head 22 comprises a high pressure water inlet chamber 26; a poppet valve assembly 28; a pneumatic poppet valve actuator assembly 30; a tubular nozzle body 32; an orifice assembly 34; a sealant mixing chamber 36; a sealant mixing tube 38; and a nozzle discharge orifice 40.

The high pressure water inlet chamber 26 is connected to a source of high pressure water (typically about 5,000 to 100,000 psig) through a high pressure water line 42. The high pressure water inlet chamber is connected to the tubular nozzle body 32 through the poppet valve assembly 28. When the cutting head is in operation, the poppet valve of the poppet valve assembly 28 is opened by the pneumatic poppet valve actuator assembly 30 allowing the high pressure water to flow through the nozzle body. The pneumatic poppet valve actuator assembly 30 is connected to a source of control air through control air line 31.

The nozzle body 32 empties into the sealant mixing chamber 36 through the orifice assembly 34. As the water passes through the orifice assembly 34, the water jet formed creates a partial vacuum in the sealant mixing chamber 36 which draws sealant into the sealant mixing chamber 36 from a sealant delivery line 44.

The sealant (in powdered or liquid form) is drawn into and mixes with the water jet formed in the mixing chamber 36 and is further mixed with and dissolved in the water as the water and sealant pass through the mixing tube 38. The nozzle discharge orifice 40 is typically about 0.001 to about 0.050 inches in diameter and the water sealant solution is discharged from the nozzle discharge orifice as a high energy, focused liquid jet 71 which is directed at and cuts the fibrous work piece.

As shown in FIG. 1, the sealant metering system 24 includes a sealant hopper 46 and a sealant metering valve assembly 48. The sealant hopper 46 contains a supply of about 300 pounds of sealant in either powdered or liquid form. Typical sealants used in this invention are vinyl acetate ethylene copolymers, such as, AIRFLEX# 300 EMULSION copolymer; AIRFLEX# 400 EMULSION copolymer; and AIRFLEX# 465 EMULSION copolymer; all of which are manufactured by Air Products and Chemicals, Inc. of Allentown, Pa. The sealant can include anti-static agents, dyes, and/or adhesives in liquid or powder form which would also be mixed in the liquid jet 71 and applied to the edges of the kerf created in the cutting operation.

The reduced pressure zone created in the mixing chamber 36 of the cutting head 22 during the operation of the cutting, sealing and encapsulating apparatus normally draws the sealant from the sealant hopper 46 into the mixing chamber 36. However, with certain sealants or under certain operating conditions, the sealant hopper 46 can be pressurized to assist in the delivery of the sealant to the mixing chamber 36 when the cutting, sealing and encapsulating apparatus is in operation. The sealant hopper 46 is pressurized to a predetermined pressure ( e.g. about 20 to 70 psig) by pressurized air supplied through pressurized air supply line 50.

The sealant metering valve assembly 48 is attached to an exit port of the sealant hopper 46 and connects the exit port of the sealant hopper with the sealant delivery line 44. The sealant metering valve assembly 48 is a conventional commercially available control valve, such as the M-238 Automated Abrasive Metering Valve, sold by Flow International Corp. of Kent, Wash., and includes an on/off valve 52, a separate metering valve 54 and a purge valve 56. The on/off valve 52 of the sealant metering assembly is a sliding shutter or gate valve that is actuated by an air cylinder. The separate metering valve 54 is a manually adjustable, digital micrometer that is manually set to a predetermined sealant flow rate required for a particular application. The purge valve 56 consists of a needle valve connected to a source of controlled pressurized air and/or water through a pressurized supply line 58 and to the metering valve 54 to direct pressurized air and/or water into the sealant delivery line 44 at the location of the metering valve. The purge valve 56 provides a simple, adjustable way to clear the sealant delivery line 44 of any sealant when the cutting, sealing and encapsulating apparatus 20 is shut down. The needle valve is also actuated by an air cylinder. Control air for operating the air cylinders that actuate the on/off valve 52 and the purge valve 56 is supplied to the sealant metering valve assembly through control air lines 60 and 62.

Figure 2:
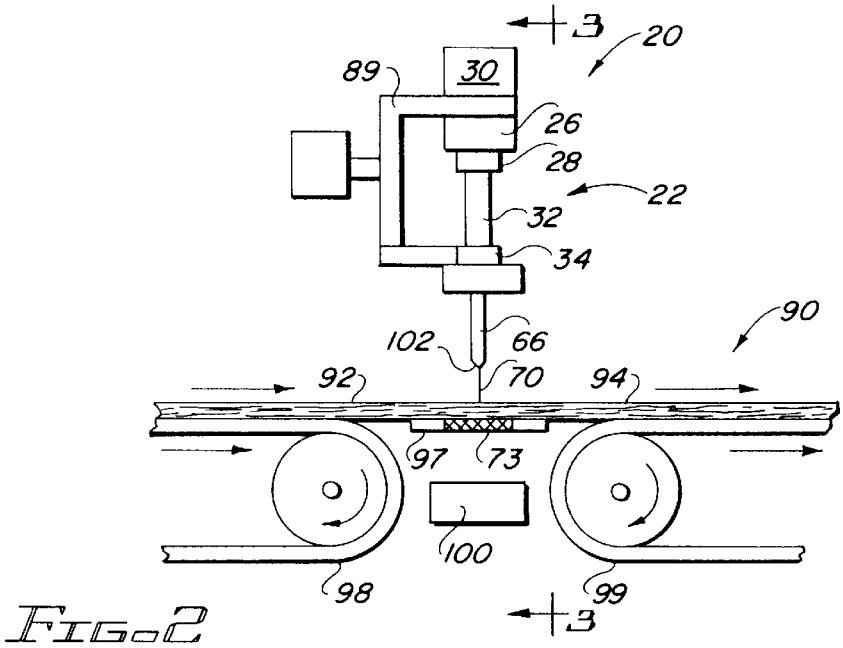
FIG. 2 is a schematic side elevation of a production line showing the cutting, sealing and encapsulating apparatus and the air hold down assembly mounted on a manipulator assembly for making a longitudinal cut in a thin, uncured, fibrous mat product.
Figure 3:
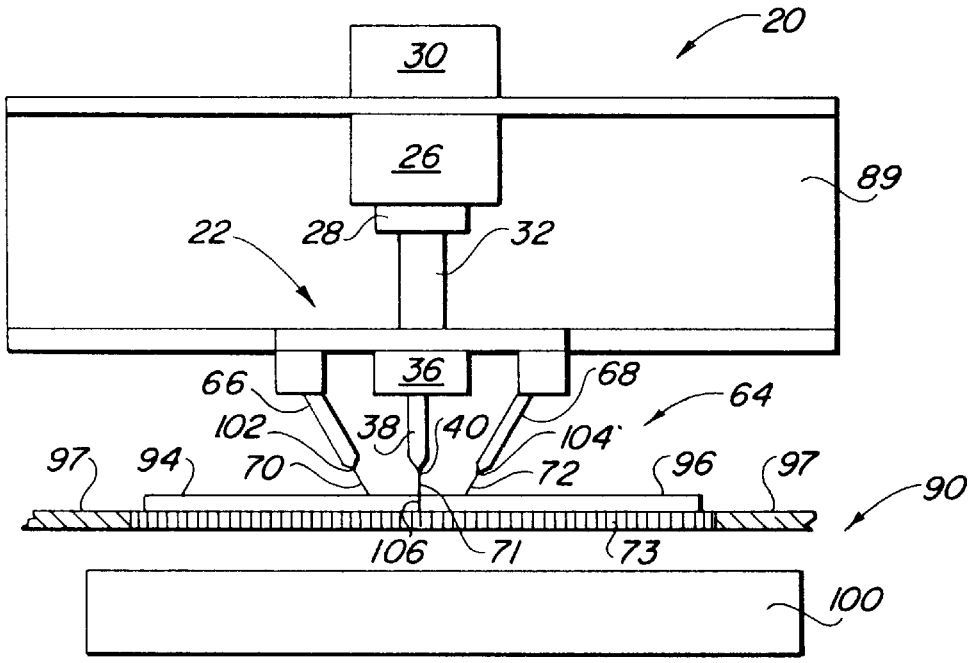
FIG. 3 is a schematic elevation, in section, of the production line of FIG. 2 taken substantially along lines 3—3 of FIG. 2 to better illustrate the use of the hold down air jets in the cutting of thin, uncured, fibrous mat products.
Figure 4:
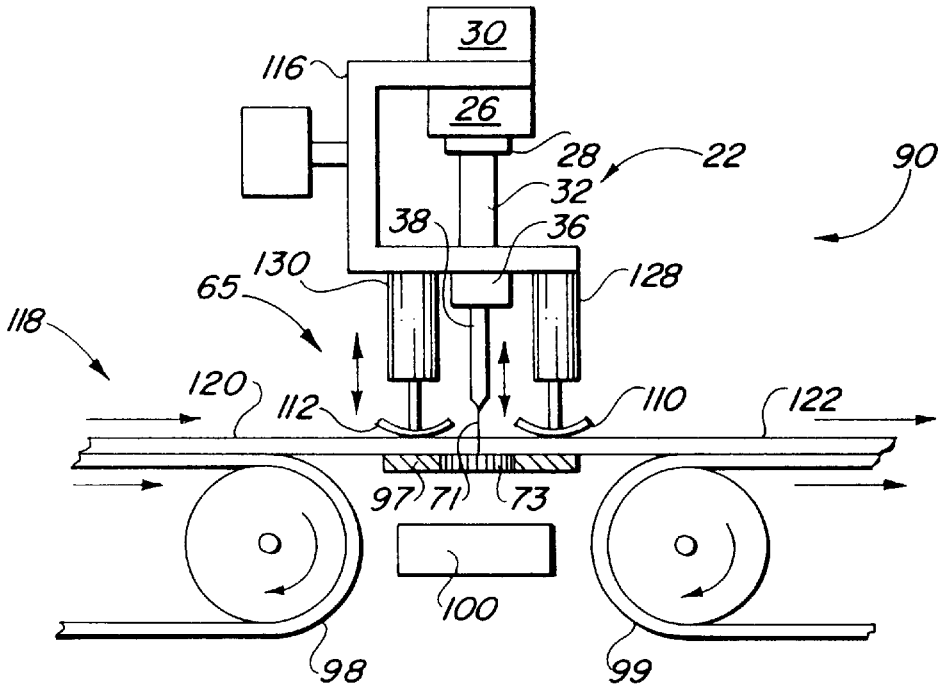
FIG. 4 is a schematic side elevation of a production line showing the cutting, sealing and encapsulating apparatus and a mechanical hold down assembly mounted on a manipulator assembly for making a transverse cut in a thin, cured, fibrous mat product.

The cutting, sealing and encapsulating apparatus can also include a work piece hold down assembly, such as, the air hold down assembly 64 shown in FIGS. 1–3 or the mechanical hold down assembly 65 shown in FIG. 4. The work piece hold down assembly is used when thin (less than ½ inch thick) fibrous work pieces are being cut. The hold down shoe enables the thin fibrous work piece to be cut without creating ragged or "paper tear" edges on the kerf made by the cutting operation.

The air hold down assembly 64 is preferred for use in the cutting of uncured fibrous work pieces 92 so that the work piece can not stick to the hold down means. The air hold down assembly includes two, pneumatically actuated, high pressure, high velocity air nozzles 66 and 68. As best shown in FIGS. 1 and 3, the nozzles 66 and 68 are mounted on either side of the cutting head 22 and direct focused streams 70 and 72 of pressurized air onto the upper surface of the fibrous work piece adjacent the point of contact between the upper surface of the work piece and the cutting jet 71. In this way, the portions of the fibrous work piece adjacent the point of contact of the cutting jet 71 are held in compression between the high pressure, high velocity air streams 70 and 72 and the foraminous work support surface 73. In certain applications, e.g. where the fibrous work piece is being trimmed and only the condition of the edge remaining on the fibrous work piece is important, the nozzle applying an air stream to the scrap side of the cut or kerf can be shut off. The pneumatically actuated air nozzles 66 and 68 are supplied with pressurized air through pressurized air supply lines 74 and 76 and are actuated by control air through control air lines 78 and 80.

For cutting applications where the fibrous product has been cured and its binder set, the mechanical hold down assembly 65 of FIG. 4 can be used in place of the air hold down assembly 64. The mechanical hold down assembly 65 comprises a pair of vertically adjustable hold down shoes 110 and 112 that move with the cutting head 22 and compress portions of the fibrous work piece, adjacent the point of contact of the focused, high energy liquid cutting jet, between the hold down shoes 110 and 112 and a foraminous work piece support surface 73.

The cutting head 22, the sealant metering system 24 and the work piece air hold down assembly 64 (when used) are controlled by a conventional, commercially available control valve assembly 82. The control valve assembly 82 is connected to a source of control air through control air line 84 and to a source of conditioned supply air (compressed shop air) having a pressure of about 90 to 120 psig through supply air line 86 and a source of pressurized water through line 87. The control valve assembly 82 provides control air to the poppet valve actuator assembly 30 of the cutting head 22 through control air line 31 to turn the poppet valve 28 on or off and thereby control the flow of high pressure water to the cutting head. The control valve assembly 82 also provides control air to the sealant metering valve assembly 48, through the control air lines 60 and 62, to open and close the on/off, slide valve 52 and the purge valve 56 of the sealant metering valve assembly 48. The opening and closing of the on/off, slide valve 52 at the exit of the sealant hopper controls the supply of sealant from the sealant hopper 46 to the cutting head 22 and the opening and closing of the purge valve 56 allows conditioned pressurized supply air or water to be introduced into the sealant delivery line 44 to purge the line and cutting head of sealant.

The method and apparatus of the present invention can be used with various manipulator assemblies to cut, seal and encapsulate numerous fibrous products. The fibrous work piece can be held in place and the cutting head 22 of the cutting, sealing and encapsulating apparatus 20 can be moved relative to the stationary work piece to effect the cutting of the fibrous work piece. For example, fibrous work pieces, such as, hoodliners, headliners and other molded fibrous products can be cut in this manner and, as shown in FIG. 4, continuous fibrous mats can be cut into discrete lengths by moving the cutting head 22 of the cutting, sealing and encapsulating apparatus 20 transversely across the production line. In other applications, the cutting head 22 is held in place and the fibrous work piece is passed beneath the cutting head. For example, the cutting head 22 of the cutting, sealing and encapsulating apparatus 20 can be held in place in mat cutting and trimming operations where the lateral edges of the fibrous work piece are removed or the mat is cut lengthwise into a plurality of pieces as shown in FIG. 3.

FIGS. 2 and 3 show the cutting head 22 of the cutting, sealing and encapsulating apparatus 20 of the present invention mounted on a conventional manipulator assembly 89 in a production line 90 that is producing a continuous, uncured, fibrous mat or blanket 92. As shown, the cutting, sealing and encapsulating apparatus 20 is cutting the continuous piece of uncured, fibrous mat or blanket 92 longitudinally in half to form two continuous pieces of mat or blanket 94 and 96 as the mat or blanket 92 passes beneath the cutting head 22 of the cutting, sealing and encapsulating apparatus. As the mat or blanket 92 is being cut by the cutting jet 71 emitted by the cutting head 22, the blanket or mat 92 slides over and is supported on the foraminous surface 73 of a stainless steel dead plate 97 located between conveyor belts 98 and 99. The foraminous surface 73 of the dead plate 97 permits the liquid from the focused, high energy cutting jet 71 to pass through the mat or blanket and the dead plate to be collected in a reservoir 100 for disposal.

In operation, the cutting head 22 and the hold down air nozzles 66 and 68 are adjusted to a predetermined spacing above the foraminous work piece support surface, such as, the foraminous support surface 73 of FIGS. 2 and 3. The spacing of the discharge ends of the cutting head 22 and the hold down air nozzles 66 and 68 above the foraminous work piece support surface 73 is determined by the thickness of the fibrous work piece, such as, the continuous fibrous mat or blanket 92.

The greater the spacing between the discharge end of the cutting head 22 and the upper surface of the fibrous work piece, the more the cutting energy of the cutting jet 71 is dissipated before the jet performs its cutting operation. Ideally, there should be no space between upper surface of the fibrous work piece and the discharge ends of the cutting head 22 and the hold down air nozzles 66 and 68. However, the discharge ends of the cutting head and the hold down air nozzles must be spaced above the upper surface of the fibrous work piece a distance sufficient to clear irregularities in the fibrous work piece surface and deviations in manipulator movement. Accordingly, the cutting head 22 and the hold down air nozzles are normally spaced above the foraminous support surface a distance to place the nozzle discharge orifice 40 of the cutting head 22 about 0.030 inches to about 2.00 inches above the upper surface of the fibrous work piece 92 and the nozzle discharge orifices 102 and 104 of the hold down air nozzles 66 and 68 about 0.030 inches to about 2.00 inches above the upper surface of the fibrous work piece 92.

The cutting head 22 is oriented perpendicularly with respect to the upper surface of the fibrous work piece 92 to direct the high energy liquid jet 71 perpendicular to the upper surface of the work piece to effect the cutting of the work piece. The hold down air nozzles 66 and 68 are directed at an angle to the upper surface of the work piece 92 and the high energy cutting jet 71 to cause the air streams 70 and 72 to contact the upper surface of the work piece 92 adjacent the point of contact between the high energy liquid jet 71 and the upper surface of the work piece 92. Thus, the portions of the work piece, adjacent where the cutting is taking place and, if desired, on both sides of the kerf 106 being formed in the work piece, are held in compression between the air streams and the foraminous support surface 73. The high energy liquid jet 71 typically exits the cutting head orifice at pressures of about 5,000 psig to about 100,000 psig and at a velocity of about 1,000 to about 5,000 feet per second. The air streams 70 and 72 typically exit the nozzles 66 and 68 at pressures of about 5 psig to about 100 psig.

Before the cutting, sealing and encapsulating apparatus 20 is placed into operation, the metering valve 54 of the sealant metering valve assembly 48 is manually adjusted to the appropriate micrometer setting for the desired sealant flow rate. Next the poppet valve 28 is opened to deliver high pressure water from the high pressure water line 42 into the cutting head 22. At the same time that the poppet valve 28 is opened, the on/off valve 52 of the sealant metering valve assembly is opened and sealant from the sealant hopper 46 flows into the sealant delivery line 44. The partial vacuum created in the mixing chamber 36 of the cutting head 22 by the water stream in the mixing chamber draws the sealant into the mixing chamber where the sealant is mixed with the water stream. As discussed above, if desired, the sealant hopper 46 can be pressurized to assist in the delivery of the sealant to the mixing chamber.

As the water and sealant pass through the sealant mixing tube 38, the sealant is blended with and dissolves in the water stream. The focused, high energy liquid jet 71 emitted by the nozzle discharge orifice 40 of the cutting head is a homogeneous blend of the water and sealant.

When one or both of the hold down air nozzles 66 and 68 are being used, high pressure air is supplied to these nozzles at the same time as or slightly before the high pressure water is delivered to the cutting head 22 and the sealant is delivered to the sealant delivery line 44. Thus, as the cutting of the fibrous work piece commences, the portions of the work piece adjacent the point of contact between the cutting jet 71 and the work piece are held in place to facilitate the formation of clean edges on the kerf 106 formed by the cutting operation.

As the focused, high energy liquid jet 71 contacts the fibrous work piece, the jet erodes away portions of the fibers in its path and forms the cut or kerf 106 in the work piece. At the same time the work piece is being cut, sealant from the high energy liquid jet 71 is being deposited on the edges of the kerf 106 to seal the edges and encapsulate dust and short lengths of fibers created by the cutting operation. The liquid from the jet 71 that passes through the fibrous work piece also passes through the foraminous work piece support surface 73 where it is collected in the reservoir 100 for disposal.

As discussed above, the fibrous work piece is moved relative to the cutting head 22 by either passing the work piece beneath the cutting head or by passing the cutting head 22 over the work piece. The manipulator assemblies used to position and move the cutting head 22 and the hold down air nozzles 66 and 68 relative to the fibrous work piece are conventional and commercially available. Since the particular manipulator assembly used to position and move the cutting head 22 and the hold down air nozzles 66 and 68 does not form part of the invention, the structures of the various manipulator assemblies that can be used with the cutting, sealing and encapsulating assembly 20 of the present invention will not be discussed in detail.

When the cutting, sealing and encapsulating operation is completed, the poppet valve 28 is closed shutting off the high pressure water supply to the cutting head 22, the on/off valve 52 of the sealant metering valve assembly 48 is closed shutting off the supply of sealant to the sealant delivery line 44 and the mixing chamber 36, and the high pressure air supply to the air nozzles 66 and 68 is shut off. Simultaneously, the purge valve 56 of the sealant metering valve assembly 48 is opened and controlled pressurized air and/or water passes through the needle valve into the sealant delivery line 44. The controlled pressurized air and/or water passes from the sealant delivery line 44 into the sealant mixing chamber 36, the sealant mixing tube 38 and out through the nozzle discharge orifice 40 of the cutting head clearing the sealant delivery line 44 of sealant. The poppet valve 28 is then reopened for a brief period of time to flush out any sealant remaining in the cutting head 22 with high pressure water from supply line 42 to keep the nozzle from becoming clogged.

It is also contemplated that controlled pressure water can be introduced into the sealant hopper 46 and from the hopper into the delivery line 44 to clear the delivery line 44 and the cutting head 22 of sealant. As the controlled pressure water passes through the sealant hopper 46, the sealant delivery line 44, the sealant mixing chamber 36, the sealant mixing tube 38 and out through the nozzle orifice 40, the pressurized water purges sealant from these components and thereby prevents the components from becoming clogged with sealant.

FIG. 4 shows the cutting, sealing and encapsulating apparatus 20 of the present invention and the mechanical hold down assembly 65 mounted on a conventional manipulator assembly 116 in a production line 118 that is producing a continuous, cured, fibrous mat or blanket 120. As shown, the cutting, sealing and encapsulating apparatus 20 is cutting the continuous, cured fibrous mat or blanket 120 into discrete lengths of mat or blanket 122. The manipulator assembly 116 moves the cutting head 22 of the cutting, sealing and encapsulating apparatus 20 and the mechanical hold down assembly 65 transversely across the fibrous mat or blanket 120 to cut the mat or blanket into discrete lengths. The mat or blanket 120 is supported on and slides over the foraminous surface 73 of the dead plate 97 as the blanket or mat 120 is being cut by the focused high energy jet 71. The foraminous surface 73 permits the liquid from the focused, high energy jet 71 to pass through the mat or blanket and the dead plate 97 to be collected in the reservoir 100 for disposal.

During the cutting operation, the mat or blanket 120 is stationary while the cutting head 22 and the hold down assembly 65 move transversely across the mat or blanket 120. Once the cut has been completed, the mat or blanket 120 is indexed ahead a predetermined distance and stopped for the next cutting operation. If it is desired to keep the upstream portion of the mat or blanket production line 90 in continuous operation while the mat or blanket is stopped and being cut by the cutting head 22, a conventional loop accumulator can be used in the production line upstream of the cutting, sealing and encapsulating station to intermittently accumulate the mat or blanket during the cutting operation.

In operation, the cutting head 22 of the cutting, sealing and encapsulating apparatus 20 and the shoes 110 and 112 of the mechanical hold down assembly 65 are adjusted to a predetermined spacing above the foraminous work piece support surface, such as, the foraminous surface 73 of the dead plate 97 of FIG. 4. As with the cutting, sealing, and encapsulating operation described in connection with FIGS. 1–3, the spacing of the discharge end of the cutting head 22 and the hold down shoes 110 and 112 above the foraminous work piece support surface 73 is determined by the thickness of the fibrous work piece, such as, the continuous mat or blanket 120 shown in FIG. 4. The hold down shoes 110 and 112 keep the fibrous work piece 120 compressed adjacent the point of cutting by the high energy liquid jet 71 and are curved so that fibers of the fibrous work piece do not become entangled on the hold down shoes. The height of the hold down shoes 110 and 112 above the work piece support surface 73 is adjusted by conventional, pneumatic or hydraulic cylinders 128 and 130 mounted on the manipulator assembly 116.

The cutting, sealing and encapsulating operation, using the mechanical hold down assembly 65, is essentially the same as the cutting sealing and encapsulating operation described above in connection with the use the air hold down assembly 64. The only difference is the substitution of the mechanical hold down assembly for the air hold down assembly when a cured work piece is being cut rather than an uncured work piece. Accordingly, the cutting, sealing and encapsulating operation described above in connection with the use of the air hold down assembly 64 will not be repeated. In describing the invention certain embodiments have been used to illustrate the invention and the practice thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of simultaneously cutting and sealing a fibrous work piece comprising:

providing a fibrous work piece;

introducing and mixing a sealant into a liquid prior to said liquid exiting a nozzle as a focused, high energy liquid jet;

cutting said fibrous work piece by directing said focused, high energy liquid jet from said nozzle onto a surface of said fibrous work piece;

sealing an edge of a kerf formed by said cutting of said fibrous work piece with said sealant carried in said focused, high energy liquid jet to encapsulate dust and short length fibers formed by said cutting of said fibrous work piece; and placing portions of said fibrous work piece in compression adjacent where said focused, high energy liquid jet is cutting said fibrous work piece by directing at least one stream of high pressure air onto the surface of said fibrous work piece adjacent where said focused, high energy liquid jet is cutting said fibrous work piece to facilitate the formation of a clean edge on said kerf.

2. The method of claim 1 wherein: said focused, high energy liquid jet has an operating pressure of at least 5,000 psig and a velocity of at least 1,000 feet per second.

3. The method of claim 1 wherein: said liquid is water and said sealant includes an anti-static agent.

4. The method of claim 1 wherein: said liquid is water and said sealant includes an adhesive.

5. The method of claim 1 wherein: said liquid is water and said sealant includes a dye to color said edge.

6. The method of claim 1 wherein: said fibrous work piece is held in compression adjacent where said focused, high energy liquid jet is cutting said fibrous work piece by directing streams of high pressure air onto the surface of said fibrous work piece adjacent where said focused, high energy liquid jet is cutting said fibrous work piece and on opposite sides of the kerf formed by said cutting of said fibrous work piece.

7. The method of claim 1 wherein: said fibrous work piece comprises glass fiber mat.

8. The method of claim 1 wherein: said fibrous work piece comprises randomly oriented glass fibers adhesively bonded together at their points of intersection.

9. The method of claim 1 wherein: said fibrous work piece is a molded fiber glass board.

10. The method of claim 1, wherein: said fibrous work piece is a woven glass fiber mat.

* * * * *